United States Patent [19]

Landa

[11] 4,326,792

[45] Apr. 27, 1982

[54] COMBINED REGISTRATION IMAGE TRANSFER AND PICKOFF ASSEMBLY FOR ELECTROPHOTOGRAPHIC COPIER

[75] Inventor: Benzion Landa, Edmonton, Canada

[73] Assignee: Savin Corporation, Valhalla, N.Y.

[21] Appl. No.: 107,822

[22] Filed: Dec. 28, 1979

[51] Int. Cl.[3] ..... G03G 15/00

[52] U.S. Cl. ..... 355/3 TR; 271/277; 355/3 SH; 355/14 SH

[58] Field of Search ..... 355/3 R, 3 SH, 3 TR, 355/14 TR, 14 SH; 271/82, 277

[56] References Cited

U.S. PATENT DOCUMENTS

| | | | |
|---|---|---|---|
| 3,239,215 | 3/1966 | Davis et al. | 271/277 |
| 3,567,213 | 3/1971 | Lagonegro et al. | 271/82 X |
| 3,702,482 | 11/1972 | Dolcimascolo et al. | 355/3 TR X |
| 3,827,803 | 8/1974 | Shelffo et al. | 271/82 X |
| 4,244,648 | 1/1981 | Schultes et al. | 355/3 SH X |

*Primary Examiner*—Fred L. Braun

*Attorney, Agent, or Firm*—Shenier & O'Connor

[57] ABSTRACT

A combined registration, image transfer and pickoff assembly for an electrophotographic copier in which a transfer pressure roller having an elastomeric outer layer with a hardness approximating that of the copy paper is disposed across the imaging drum at a spacing from the drum greater than the thickness of the image toner layer but less than that of the copy sheet. A registration roller is urged into line engagement with the transfer roller to form a registration nip for receiving the leading edge of a copy sheet prior to its movement through the transfer nip. A selectively actuable gripper carried by the transfer roller is opened to receive the leading edge of the copy sheet when it enters the registration nip, then retracted to clamp the leading edge and carry it around with the transfer roller through the transfer nip, and reopened on the other side of the transfer nip to allow the leading edge to be peeled from the transfer roller and directed along an exit path. The transfer roller is driven independently of the imaging surface through a spring clutch which is overdriven by the imaging surface when the copy sheet is moving through the transfer nip and which finally disengages when the gripper is aligned with the registration roller. To prevent contamination by non-image toner deposits during start-up, the transfer roller is retracted from the imaging surface until the image-bearing portion of the imaging surface reaches the transfer station.

12 Claims, 11 Drawing Figures

COMBINED REGISTRATION IMAGE TRANSFER AND PICKOFF ASSEMBLY FOR ELECTROPHOTOGRAPHIC COPIER

BACKGROUND OF THE INVENTION

This invention relates to a single subassembly which is adapted to perform all of the registration, image transfer and pickoff functions in an electrophotographic copier.

Electrophotographic copiers of the image transfer type, commonly referred to as plain paper copiers, are well known in the art. In copiers of this type, a repetitively used photoconductive surface such as that of a conductive drum coated with selenium is uniformly electrostatically charged and then is exposed to a light image of an original to form an electrostatic latent image. The surface then moves through a developing station at which a suitable developer is applied to the surface to form a developed toner image and to a transfer station at which the developed image is transferred to a copy sheet, which is usually a sheet of plain paper.

In at least one type of plain paper copier known in the art, the copy sheet to which the image is to be transferred is advanced to the nip between a pair of registration rollers spaced from the photoconductor drum and stops. In response to movement of the machine scanner, the registration rollers are driven to advance the copy sheet to the transfer station so that the leading edge thereof arrives at the transfer station in synchronism with the arrival of the leading edge of the image on the photoconductor. After the image has been transferred to the copy sheet, the sheet moves with the photoconductive surface to a pickoff station at which the leading edge of the sheet is stripped from the surface of the photoconductor and the sheet is carried away for delivery to the customer. U.S. Pat. No. 4,009,957 shows a copying machine of the type described.

It will be appreciated that each of the individual image transfer and pickoff systems of the type described above requires a certain amount of space around the photoconductive drum. Where an attempt is made to reduce the drum diameter thus to reduce the cost of a copying machine, the limiting factor most likely will be the amount of equipment which must be positioned adjacent to and around the drum to perform the required operations. Clearly, the provision of separate assemblies for transfer and for pickoff limits the extent to which the size of the drum can be reduced. Obviously, also, the registration rollers occupy space in the machine cabinet.

In addition to the foregoing, pickoff assemblies of the prior art suffer from a number of defects. Mechanical devices such as blades and the like which are adapted to lift the leading edge of the copy sheet off the drum, while simple, are relatively unreliable since they must overcome not only the mechanical adhesion between the paper and wet imaging surface but also electrostatic forces which usually are present. As an alternative mechanical expedient, it has been suggested that a stationary strip be placed at the edge of the drum at the transfer station so that a side of a copy sheet fed to the drum at the transfer station is received by the strip to maintain a separated paper edge. This expedient, however, reduces the effective width of the copy sheet and may result in loss of a part of the information on the original.

My co-pending application, Ser. No. 085,689 filed Oct. 17, 1979, for a Combined Transfer and Registration System for Electrophotographic Copier discloses an arrangement in which transfer of the developed image from the surface of the photoconductor to the transfer medium is effected by a roller which is spaced from the photoconductor by a distance which is less than the thickness of a sheet of copy material and which has a hardness approximately that of the copy material. In addition the transfer roller of the apparatus shown in my co-pending application cooperates with another roller to form a nip thus to perform the additional function of acting as a registration roller. Not only does this system achieve a most effective image transfer even where relatively rough copy material is used but also it appreciably simplifies the apparatus over that described above.

SUMMARY OF THE INVENTION

One object of my invention is to provide a single subassembly which combines the functions of registration, image transfer and pickoff in an electrophotographic copier.

Another object of my invention is to provide an assembly which contributes to the reduction in size of the photoconductor drum in an electrophotographic copier.

Another object of my invention is to provide a combined registration, image transfer and pickoff assembly for an electrophotographic copier which minimizes the length of the copy paper path in the machine.

A further object of my invention is to provide a combination, registration, image transfer and pickoff assembly for an electrophotographic copier which reliably separates the copy sheet from the imaging surface following image transfer.

A still further object of my invention is to provide a combined registration, image transfer and pickoff assembly for an electrophotographic copier which does not reduce the effective image area of the copy sheet.

Yet another object of my invention is to provide a combined registration, image transfer and pickoff assembly incorporating a pickoff which is more positive in action than are pickoffs of the prior art.

Other and further objects of my invention will appear from the following description.

In general, my invention contemplates the provision of a combined registration, image transfer and pickoff assembly for an electrostatic copier in which the leading edge of a sheet to which an image is to be transferred is fed to a ready position in the nip between a registration roller and a combined pickoff and transfer roller and at which a portion of the leading edge is disposed in the open mouth of gripper means carried by the pickoff and transfer roller outboard of the registration roller. The pickoff and transfer roller is disposed closely adjacent to the surface of the drum. In response to movement of the transfer roller in timed relationship with arrival of the leading edge of the image on the drum, the gripper closes and the transfer roller is driven to cause the sheet to move into the space between the drum and the transfer roller. In the course of its movement into the space between the drum and the transfer roller, the copy sheet clutches the drum and roller together for movement as a unit at the surface speed of the drum and the image is transferred to the copy sheet. In response to a further predetermined movement of the transfer roller, the gripper releases the sheet to a system for conveying the sheet to the user.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENT

Figure 2:
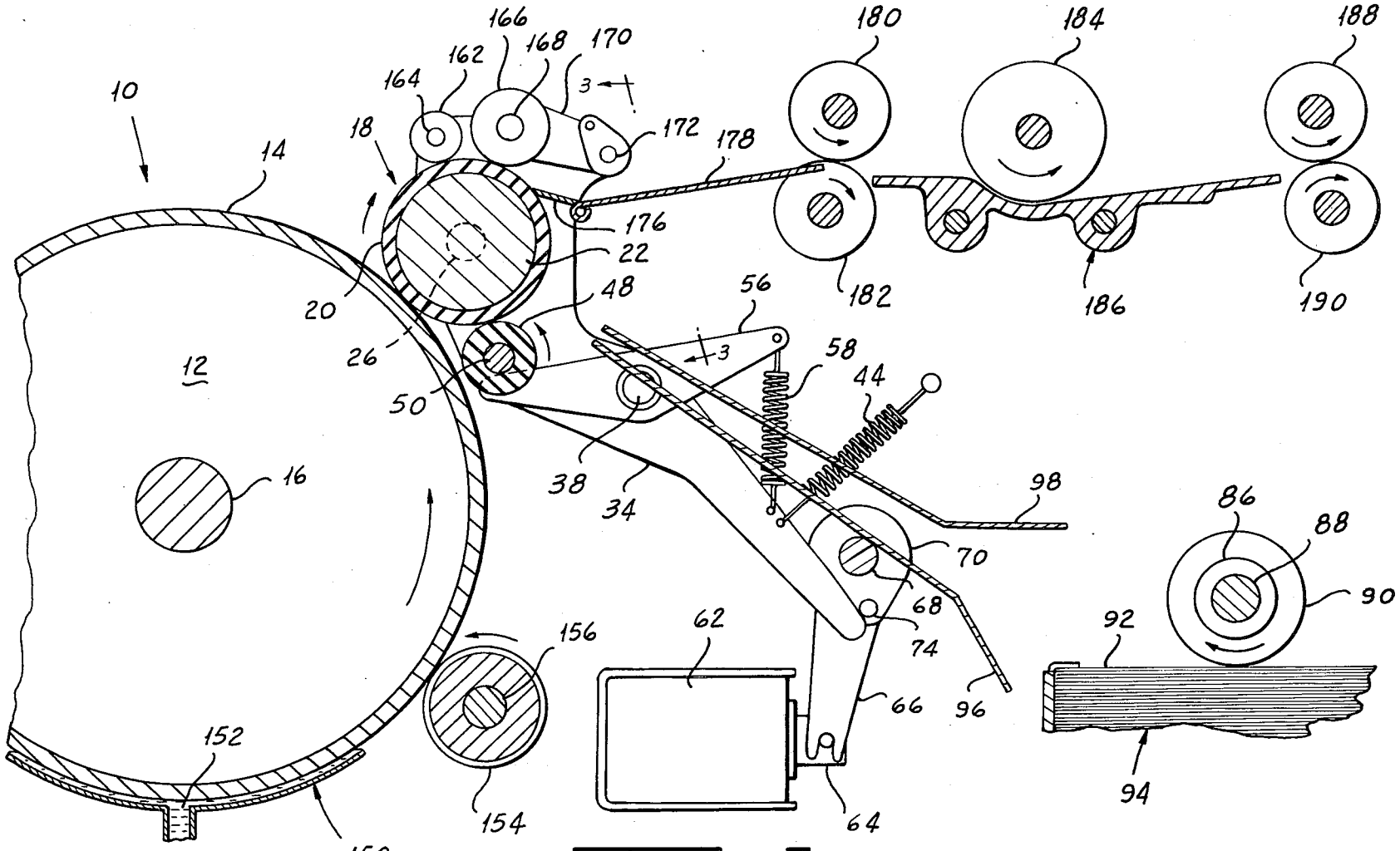
FIG. 2 is a fragmentary section of the assembly shown in FIG. 1, taken along line 2—2.

Referring now to the drawings, an electrophotographic copier, indicated generally by the reference character 10, incorporating my combined registration, image transfer and pickoff assembly includes a cylindrical drum 12 having a photoconductive imaging surface 14. During operation of the copier 10, means not shown cause drum 12 and its shaft 16 to rotate in a counterclockwise direction as viewed in FIG. 2.

The pickoff and transfer roller of my assembly, indicated generally by the reference character 18, comprises an elastomeric outer layer 20 carried by a solid metal core >receiving stub shafts 24 and 26 at the ends thereof. Each of a pair of spacing rollers 28 and 30 mounted at the ends of transfer roller 18 has a radius approximately 0.05 millimeter larger than that of transfer roller 8. As a result, when rollers 28 and 30 ride upon the surface 14 of drum 12, the surface of transfer roller 18 is spaced by approximately 0.05 millimeters from imaging surface 14. The spacing 0.05 millimeter is about one-half the thickness of the paper normally used with my copier and is considerably greater than the thickness of the developer layer left on surface 14 in the course of normal operation of the machine. Preferably, since the roller 18 is initially driven at a surface speed which is less than that of drum 12, the rollers 28 and 30 form the outer rings of bearings on the shafts 24 and 26. Shafts 24 and 26 are journaled in the ends of respective transfer roller mounting or pivot arms 32 and 34 rotatably received by respective pivots 36 and 38 carried by frame portions 40 and 42. Respective springs 44 urge arms 32 and 34 to rotate in a counterclockwise direction about pivots 36 and 38 to urge spacing rollers 28 and 30 against imaging surface 14. A shaft 50, the ends of which are received in respective slots 52 in transfer roller mounting arms 32 and 34, carries registration roller 48. Respective arms 54 and 56 carried by pivots 36 and 38 engage the underside of shaft 50 under the action of biasing springs 58 to urge registration roller 48 against the surface of transfer roller 18.

A shaft 68 carries a pair of spaced crank plates 70 having pins 74 adapted to act on arms 32 and 34. I connect the armature 64 of a solenoid 62 to an arm 66 on shaft 68 to rotate the shaft in a clockwise direction as viewed in FIG. 2 to lift roller 18 away from the drum 12 when the solenoid is energized.

Any suitable means (not shown) urges the uppermost sheet of paper 92 of a stack of sheets 94 against the surface of a paper feed roller 90 which rotates in a clockwise direction when actuated to advance the sheet of paper 92 between paper guides 96 and 98 to the registration nip formed by registration roller 48 and transfer roller 18. A one-way clutch 86 coupling feed roller 90 to its drive shaft 88 permits freewheeling clockwise motion.

Figure 3:
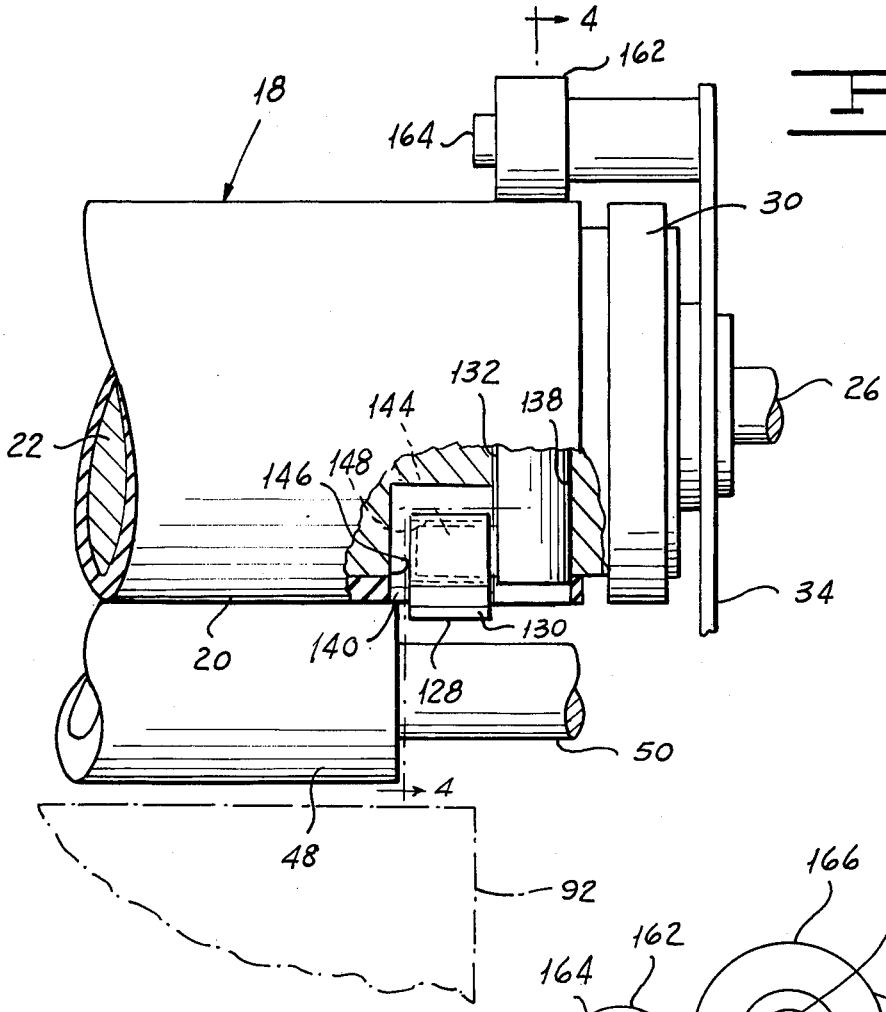
FIG. 3 is an enlarged fragmentary view of the assembly shown in FIG. 1, taken along line 3—3 of FIG. 2, illustrating the gripper and associated elements.
Figure 4:
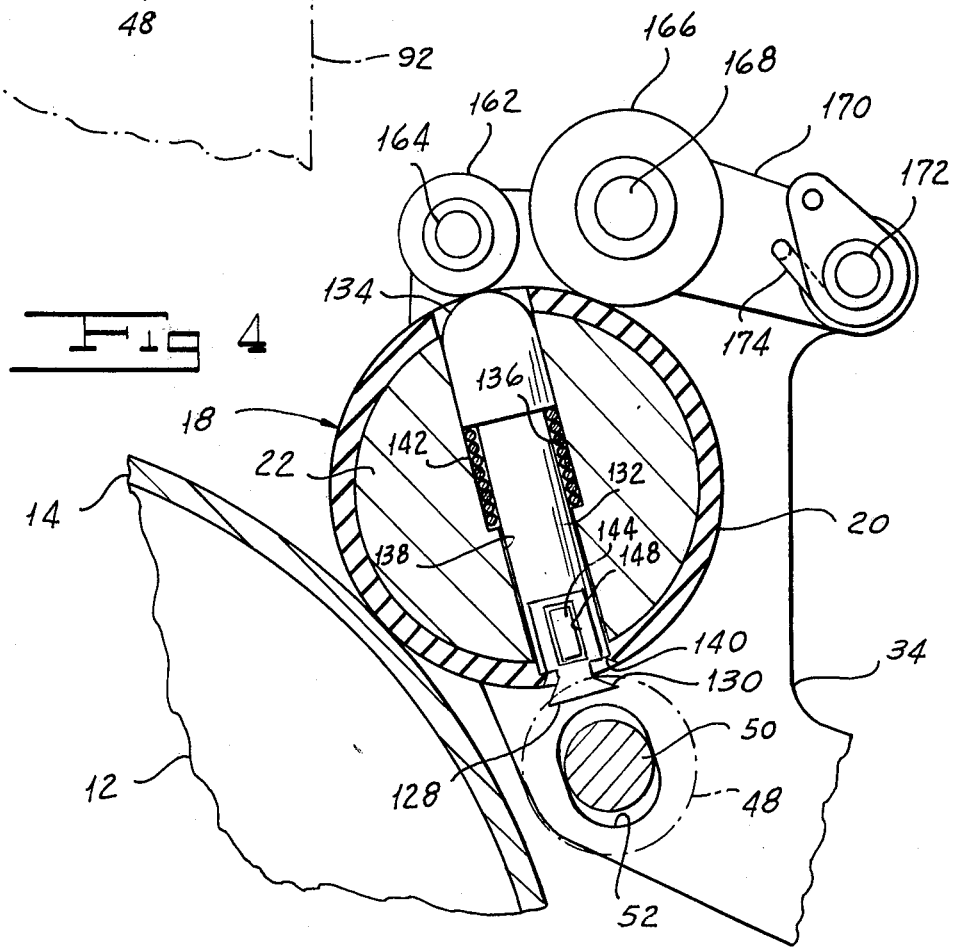
FIG. 4 is an enlarged fragmentary section of the portion of the assembly shown in FIG. 3, taken along line 4—4 thereof.

Referring now to FIGS. 3 and 4, a diametrical bore 138 formed in roller 18 adjacent to one end thereof receives a pickoff gripper or claw actuating rod 132. One end of rod 132 carries a laterally extending lug 144 which extends into a slot 148 formed in the pickoff claw or gripper 128 loosely to support the claw on rod 132. Gripper 128 is adapted to be received in a recess 146 extending laterally from bore 138 at the surface of roller 18. I form claw 128 and the mouth of recess 136 with cooperating gripping surfaces 130 and 140 adapted to receive the leading edge of a sheet of copy material in a manner to be described. A spring 142 disposed in an enlarged bore portion 136 acts on a position-sensing head 134 carried by rod 132 normally to urge claw 128 to a retracted position at which gripping surfaces 130 and 140 cooperate. Owing to the fact that claw 128 is loosely carried on rod 132, it is self-aligning. In the home or sheet-edge-receiving position of the claw 128, a roller 162 carried by a shaft 164 on arm 34 moves the claw to its extended position illustrated in FIG. 4.

Shaft 26 of roller 18 is connected through a universal coupling 100 to a spring clutch 102 which is controlled in a manner to be described so that claw 128 always returns to its home position around shaft 26 after each copy is made. Spring clutch 102 includes a driver member 104 which is driven by a pulley 106 driven by a belt 112 which is continuously driven during the operation of the copier 10. The driven, or output, member of clutch 102 carries a spring 110 which wraps around clutch member 104 in the direction of rotation of pulley 106. As a result, spring 110 tends to grab member 104, causing output shaft 108 and transfer roller 18 to rotate in a clockwise direction as viewed in FIG. 2.

Figure 6:
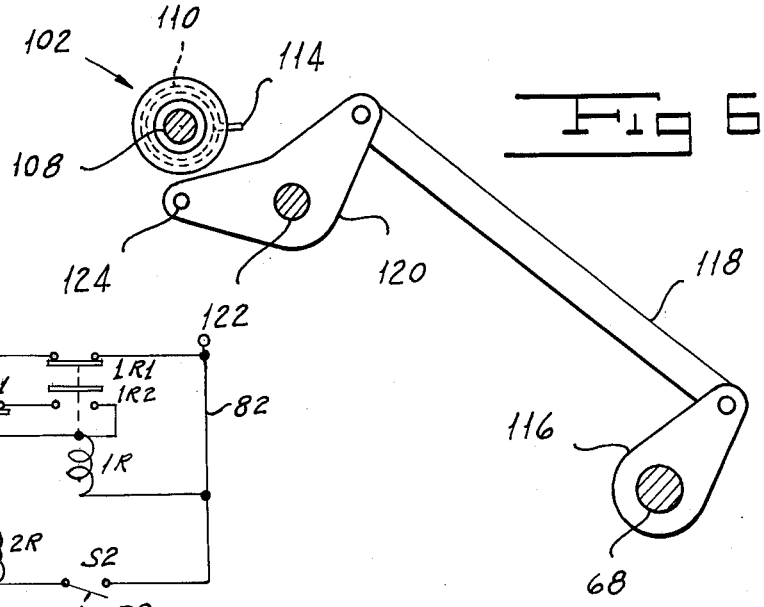
FIG. 6 is a fragmentary section of the clutch control assembly of the transfer roller shown in FIG. 1

Referring now to FIG. 6, crankshaft 68 carries a crank 116 coupled by a link 118 to the end of one arm of a bell crank 120 supported by a pivot shaft 122. A pin 124 carried at the end of the other arm or bell crank 120 is arranged to strike an outwardly directed extension 114 of the free end of the spring 110 to disengage spring clutch 102 whenever solenoid 62 is energized.

Figure 1:
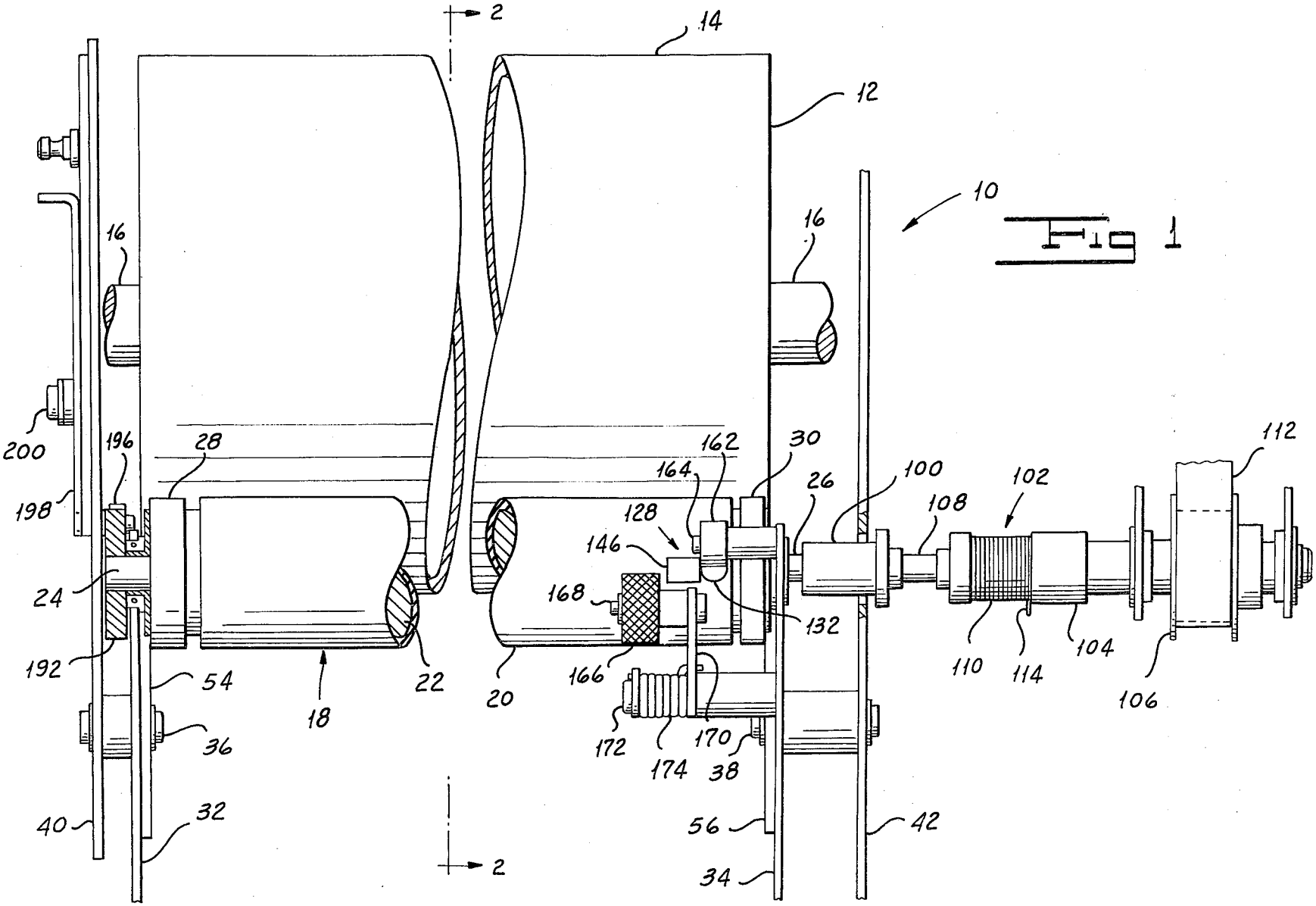
FIG. 1 is a fragmentary top plan, with parts shown in section and other parts omitted, of an electrophotographic copier incorporating my combined registration, image transfer and pickoff assembly.
Figure 5:
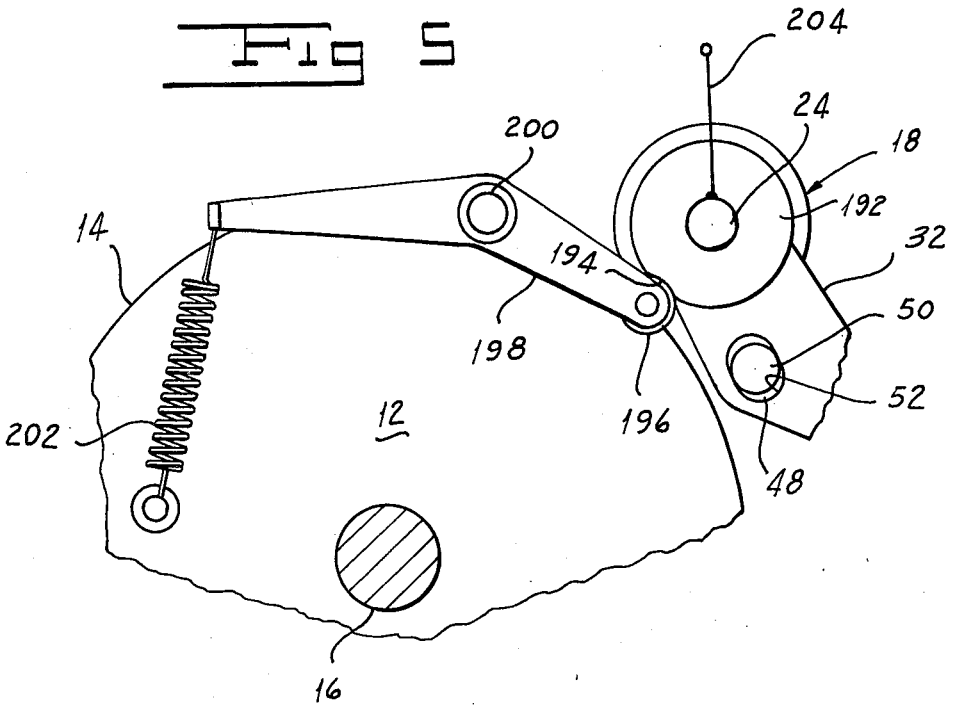
FIG. 5 is a front elevation of the cam-and-roller assembly of the transfer roller shown in FIG. 1.

Referring now to FIG. 5, further to ensure that transfer roller 18 stops at the proper angular position at the end of a copy cycle, I mount a cam 192 having a semicircular notch 194 at the left end of shaft 24 as seen in FIG. 1. A bell crank 198 mounted on a fixed pivot 200 carries a roller 196 at the end of one arm, while a spring 202 stretched between the end of the other arm and a fixed support biases roller 196 against the surface of cam 192. I so orient cam 192 that, when the gripper 128 is in the proper initial angular position shown in FIG. 4, roller 196 engages notch 194.

In operation of the form of copier 10 illustrated in FIGS. 1 to 7, when a copy is to be made, the imaging surface 14 is moved successively past a plurality of peripheral stations (not shown) at which the surface is cleaned, then charged, and then exposed to a light image of an original to form an electrostatic latent image. The exposed portion of surface 14 is then moved through a developing station 150 at the bottom of the drum 12 at which liquid developer 152 is applied to the surface to form a developed toner image. Next, the surface 14 moves past a closely spaced "reverse" roller 154 supported by a shaft 156 and rotated counterclockwise at high speed to set up a reverse shear force, preventing excess liquid developer from being carried past the roller 154.

Initially, retraction solenoid 62 is energized to keep the transfer roller 18 retracted from the imaging surface 14 and to disengage transfer roller drive clutch 102.

After a copying cycle has been initiated, roller 90 is driven for a sufficient period of time to advance a sheet 92 of copy material into the nip between roller 48 and roller 18 and to form a slight bow in the sheet. This operation can be performed in any suitable manner known to the art such, for example, as that shown in U.S. Pat. No. 4,009,957, referred to hereinabove. As this operation takes place, a portion of the leading edge adjacent to one corner thereof enters into the space between surfaces 130 and 140. As can be seen by reference to FIG. 3, claw 128 is disposed to one side to enable this action to take place. It will readily be appreciated that the operation of feeding the leading edge of a copy sheet into the registry position in the nip between rollers 18 and 48 takes place prior to the time at which the leading edge of the developed image on surface 14 arrives at roller 18.

As is known in the art, at a predetermined point in the cycle of operation of the machine 10, a synchronization signal is generated to initiate the feeding of the copy sheet from its registration position to the surface 14 in synchronization with the arrival of the leading edge of the developed image on the surface of the drum. This synchronization or registration signal may be produced in any suitable manner. For example, in the system shown in the patent referred to hereinabove, the machine scanner strikes a switch to indicate registration.

Figure 7:
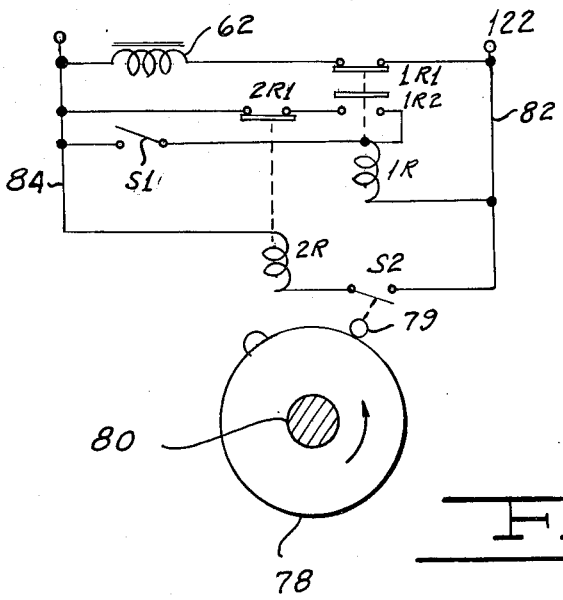
FIG. 7 is a front elevation of the solenid timing assembly of the transfer roller shown in FIG. 1.

Referring now to FIG. 7, by way of example, in one form of circuit which I may employ to control the operation of my combined registration, transfer and pickoff assembly, I connect a switch S1, adapted to be closed by the machine scanner (not shown) in a manner similar to that described in the patent referred to hereinabove, in series with a relay winding 1R between power lines 82 and 84 so that the winding is energized at registration time to open a normally closed switch 1R1 to de-energize solenoid 62 and to close a normally open switch 1R2 to complete a holding circuit through a normally closed switch 2R1 adapted to be opened upon energization of a winding 2R. I may employ any appropriate means to energize winding 2R so that solenoid 62 is not re-energized to lift the transfer roller 18 away from surface 14 before transfer is complete. For example, a cam 78 carried by a shaft 80 driven in synchronism with shaft 16 may activate a follower 79 to close a switch S2 to energize winding 2R at a time after the time it takes to transfer the image to the longest copy to be made. It is to be emphasized that the arrangement illustrated in FIG. 7 is by way of example only. It will also be possible to control the re-energization of solenoid 62 in response to the length of the copy.

As soon as solenoid 62 is de-energized in the manner described above, roller 18 moves into operative relationship with the surface 14. At the same time, pin 124 moves away from spring end 114 to permit clutch 102 to engage so that roller 18 is driven with a surface speed which is somewhat lower than that of the surface 14. As the roller is driven it cooperates with roller 48 to carry the sheet 92 toward the surface 14. Shortly after the roller 18 begins to rotate, head 134 leaves roller 162 and spring 142 urges rod 132 and claw 128 inwardly to bring surfaces 130 and 140 into operative relationship to clamp a very small portion of the leading edge of the copy sheet therebetween.

As soon as the leading edge of sheet 92 enters into the space between surface 14 and roller 18, it clutches the roller to the surface so that the roller speeds up to bring its surface speed up to that of the drum. Thus, precise synchronism between movement of the image and movement of the paper is ensured. As has been pointed out hereinabove in the course of this movement, the image is transferred to the copy paper.

If desired, transfer roller 18 may be provided with a suitable biasing potential from a line 204 coupled, for example, to shaft 24 to assist in transfer of the toner image. If the transfer roller 18 is biased in this manner, the outer layer 20 should be slightly conductive.

After the leading edge of sheet 92 leaves the transfer nip, it remains clamped to the transfer roller and thus continues to follow roller 18 beneath a hold-down roller 166 engaging transfer roller 18 at one end of the upper surface portion thereof. Roller 166 is carried by a shaft 168 mounted at the end of a pivot arm 170 carried by a pivot shaft 172 mounted on arm 34. A torsion spring 174 wound around the pivot shaft 172 biases roller 166 against transfer roller 18.

By the time the leading sheet edge clears hold-down roller 166, the position-sensing head 134 has advanced to a point at which it abuts the drum surface 14. Surface 14 deflects head 134 inwardly to move gripper 128 out of the recess 140, releasing the leading edge of the sheet 128. After the gripper 128 is lifted out of the recess 140, a plastic flap 176 carried at the leading edge of an exit paper guide 178 and biased resiliently against roller 18 in edge engagement therewith peels the leading sheet edge from the transfer roller. The sheet 92 then moves along an exit path between opposing guide rollers 180 and 182, between a drier roller 184 and a drier 186 for evaporating any residual developer liquid, and between a pair of opposing delivery rollers 188 and 190.

At a suitable point in the copy cycle sufficient to permit the longest contemplated sheet length to clear the transfer assembly, cam 78 engages microswitch S2, reacuating solenoid 62 to retract the transfer roller 18 from the imaging surface 14. At the same time, solenoid 62 moves pin 124 back to a position at which it strikes spring extension 114 on its next rotation past that position to disengage clutch 102. Because spring extension 114 has a predetermined angular position relative to gripper 128, I ensure that transfer roller 18 stops at a position in which gripper 128 is aligned with the registration nip, regardless of the actual paper length.

Referring now to FIGS. 8 to 11, I have shown a combined registration transfer and pickoff roller indicated generally by reference character 208, which is similar to the roller 18 in construction and operation as regards its registration and transfer functions. This roller, however, incorporates a different form of pickoff device than that which is provided on the roller 18.

More specifically the roller 208 which is made up of a cover 210 and a core 212, is provided with a generally cylindrical plunger-like element 214 which is supported in a diametrical bore 216 in the roller 208. The gripping surfaces of the form of pickoff shown in FIGS. 8 to 11 are formed by the under side of a screw head 218 threaded into one end of member 214 for cooperation with the surface of a countersink 220 at one end of the bore 216. A counterbore 222 at the other end of the bore 216 receives a spring 224 which bears between the bottom of the counterbore and the head 226 of a screw or the like threaded into the end of the member 214 remote from screw head 218.

A diametral opening 228 extending for some distance axially of the member 214 in the center thereof carries a shaft 232 which supports a ball bearing 230. A rod 234 slidable in an axially extending bore 236 in the body 212 is formed with a notch 238 adapted to receive the outer ring of the bearing 230. A spring 240 biased between the inner end of the bore 236 and the rod 234 normally urges the rod to a position at which bearing 230 is disposed in the notch 238. In this relative position of the parts, spring 224 urges the assembly of the plunger 214 and screw head 218 to such a position that the under surface of the head 218 is biased into engagement with surface 220. The force with which these two surfaces are urged together is sufficient to clamp a portion of the leading edge of a sheet of copy material to the roller 208. In response to an axially inwardly directed force on the rod 234 against the action of spring 240, bearing 230 rides upwardly out of the notch 238 and head 218 moves to the broken line position illustrated in FIG. 8. As will be apparent from the description hereinbelow, this relative position of the parts is the "ready" position before a pickoff operation is begun.

Figure 8:
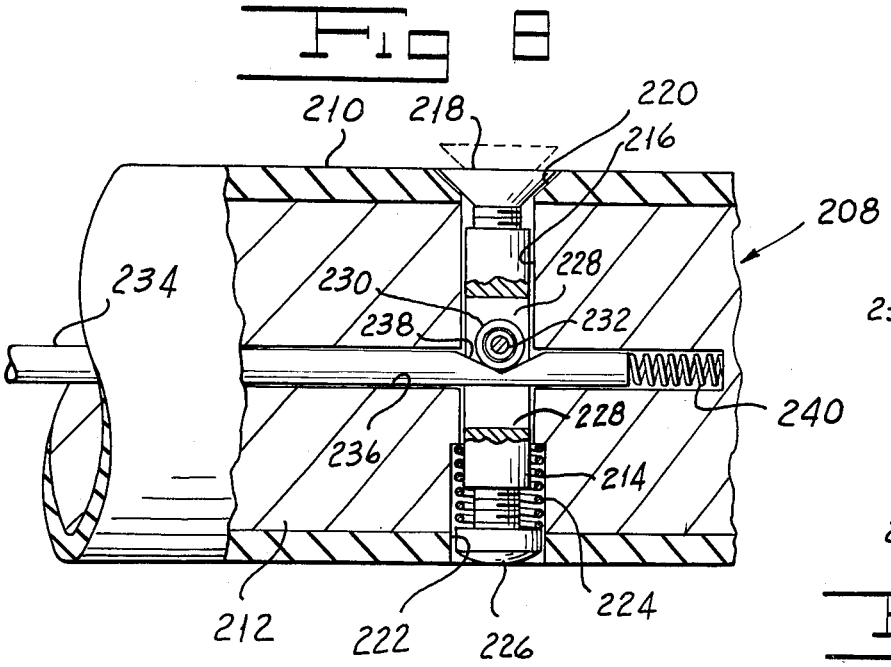
FIG. 8 is a fragmentary elevation of an alternate form of pickoff which may be incorporated in my combined registration, transfer and pickoff assembly with parts broken away and with other parts shown in section.
Figure 9:
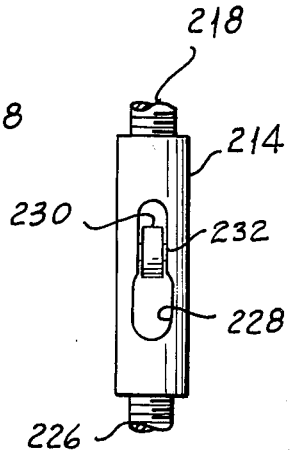
FIG. 9 is an elevation of a portion of the form of my pickoff illustrated in FIG. 8.
Figure 10:
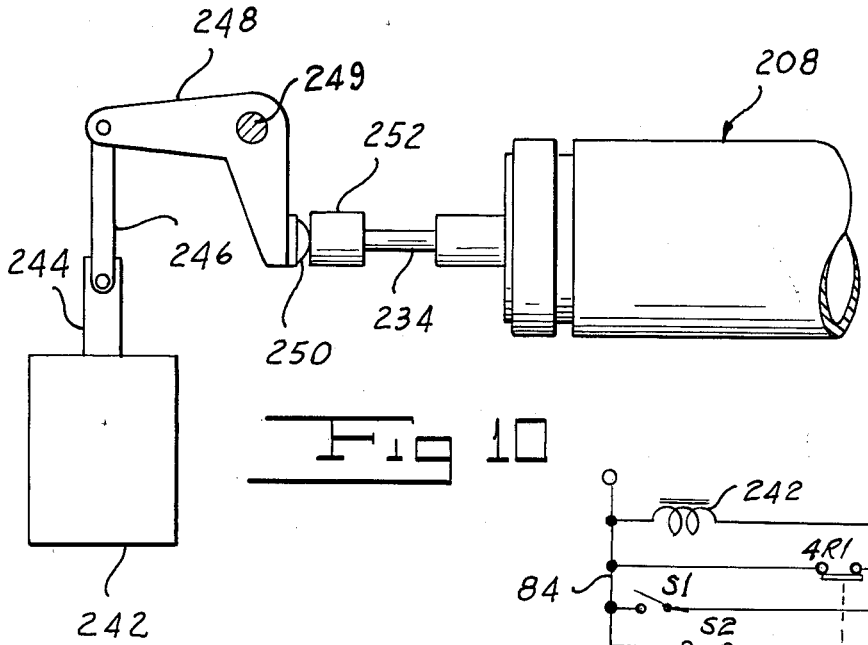
FIG. 10 is an elevation of the form of my pickoff illustrated in FIG. 8 together with its associated actuating mechanism.

From the structure described hereinabove, it will be readily apparent that prior to a transfer and pickoff operation, rod 234 should be held inwardly against the action of spring 240 so that head 218 is in the broken line position is illustrated in FIG. 8. This can be accomplished by any suitable means. For example, a solenoid 242 having an armature 244 may normally be energized to move a link 246 downwardly as viewed in FIG. 10 to cause a bellcrank 248 to rotate in a counterclockwise direction around its shaft 249 to cause a button or pad 250 on the bellcrank to engage a head 252 on rod 234 to urge the rod inwardly to a position at which head 218 is in the broken line position.

Figure 11:
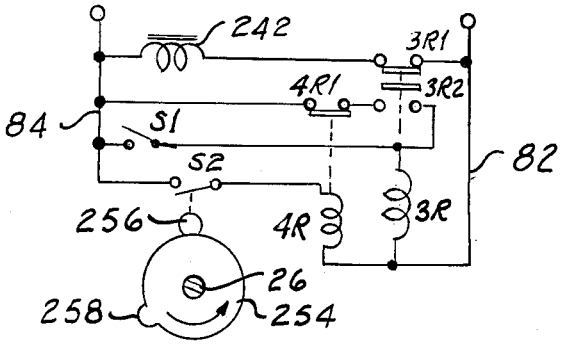
FIG. 11 is a schematic view of one form of control circuit which may be used with the form of my pickoff shown in FIG. 8.

Referring now to FIG. 11, I have shown one form of control circuit which in conjunction with the control circuit illustrated in FIG. 7 can control the operation of the form of my invention illustrated in FIG. 8 to 11. In the ready position of the parts, solenoid winding 242 is connected in series with normally closed switch contacts 3R1 between the conductors 82 and 84. When a pickoff and transfer operation is to be initiated, as has been pointed out hereinabove switch S1 is closed by the scanner carriage. This operation momentarily completes the circuit of a winding 3R to open contacts 3R1 to de-energize winding 242. At the same time, switch contact 3R2 closes to complete a holding circuit for the winding 3R through a normally closed switch contact 4R1.

It will readily be apparent that solenoid 242 should remain de-energized for a period of time sufficient to permit the roller 208 to carry the leading edge of a clamped sheet around to roller 166. This requires approximately 240° of rotation of the shaft 26. In the circuit illustrated in FIG. 11, shaft 26, which rotates in the direction of the arrow carries a cam 254 adapted to operate a follower 256. After shaft 26 has rotated through approximately 240° a node 258 on cam 254 engages follower 256 to close a normally open switch S2. When this occurs a winding 4R is energized to open the switch contact 4R1 in the holding circuit of winding 3R to de-energize the winding to permit contact 3R1 to close to re-energize solenoid 242 to move rod 234 inwardly, to move the head 218 to the broken line position as stated in FIG. 8 to release the sheet of material which has been picked-off the surface of the drum 12.

One of the significant features of the form of pickoff device shown in FIGS. 8 to 11 is that, owing to the axially directed forces which operate it, it can be operated at a considerable distance from the device itself. It is to be noted further that the illustration of a screwhead 218 which cooperates with a countersink 220 is by way of example only. In a practical embodiment of the pickoff it would be more likely to have the shape of the paper gripping element 128 of FIGS. 3 and 4.

It will be seen that I have accomplished the objects of my invention. I have provided a single subassembly which combines the functions of registration, image transfer and pickoff in an electrophotographic copier. My assembly reliably separates the copy sheet from the imaging surface without reducing the effective image area of the copy sheet. It readily accepts sheets of varying lengths. My assembly occupies a relatively short portion of the path followed by the imaging surface.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position, said clamping means comprising means forming a diametral bore in said roller, a member mounted in said bore for movement in the direction of the axis thereof, a clamping element carried by said member, means forming a clamping surface on said roller for cooperation with said element, means for biasing said member to move said element toward said surface in the closed position of said clamping means, an axial bore in said roller intersecting said diametral bore, a rod in said bore, and means responsive to a force exerted on said rod for moving said clamping means to its open position.

2. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position, said clamping means comprising means forming a diametral bore extending through said roller, a member mounted in said bore for movement in the direction of the axis thereof, a clamping element carried by one end of said member, means forming a clamping surface on said roller for cooperation with said element, an actuating element at the other end of said member, means for biasing said element toward engagement with said surface in the closed position of said clamping means, the dimensions being such that said actuating element protrudes from the end of said bore remote from said clamping element when said clamping means is in its closed position, said means normally actuating said clamping means to its open position comprising stationary means for engaging said actuating element, said means responsive to a predetermined rotary movement of said roller comprising said imaging surface engaging said actuating element.

3. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for driving said roller and for actuating said clamping means to its closed position to clamp said sheet portion to said roller to carry said sheet through said transfer station, and means responsive to a predetermined rotary movement of said roller for restoring said clamping means to its open position, said clamping means comprising means forming a diametral bore in said roller, a member mounted in said bore for movement in the direction of the axis thereof, a clamping element carried by said member, means forming a clamping surface on said roller for cooperation with said element, and means for biasing said member to move said element toward said surface in the closed position of said clamping means.

4. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adpated to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position, said means normally actuating said clamping means comprising means for exerting a force in the direction of the axis of said roller.

5. in a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for driving said roller and for actuating said clamping means to its closed position to clamp said sheet portion to said roller to carry said sheet through said transfer station, and means responsive to a predetermined rotary movement of said roller for restoring said clamping means to its open position, said means normally actuating said clamping means including means for exerting a force in direction radially of said roller.

6. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position, said clamping means including means biasing said clamping means to its closed position.

7. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuatable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position.

8. In a copier having a moving imaging surface from which a developed image is transferred to a copy sheet fed to said surface at a transfer station, apparatus including a roller, means mounting said roller in cooperative relationship with said imaging surface at said transfer station, means on said roller adaped to clamp a portion of a copy sheet to said roller for movement therewith to carry said sheet through said transfer station and then separate said portion from said imaging surface on said sheet emerges from said transfer station, means for initially positioning said clamping means at a predetermined point spaced upstream from said transfer station with reference to the direction of movement of said copy sheet, and means for ensuring that said clamping means returns to said point following a transfer operation.

9. In copying apparatus having a surface adapted to receive a toner image and adapted to be moved past a transfer station at which said image is to be transferred to a sheet of copy material and having means for generating a synchronizing signal, apparatus including a transfer roller, means mounting said transfer roller in cooperative relationship with said surface, a synchronizing roller, means mounting said synchronizing roller in cooperative relationship with said transfer roller to form a nip therewith, means for feeding a sheet of copy material to said nip, means responsive to said synchronizing signal for driving said synchronizing roller to advance said sheet from said nip toward said surface adjacent to said transfer roller, intermittently actuated means for clamping a sheet fed to said nip to said transfer roller and means responsive to said synchronizing signal for actuating said clamping means.

10. In a copier having a moving imaging surface from which a developed image is transferred to a copy sheet fed to said surface at a transfer station and having means for producing a synchronizing signal, apparatus including a transfer roller, means mounting said transfer roller in cooperative relationship with said imaging surface at said transfer station, a synchronizing roller, means mounting said synchronizing roller in cooperative relationship with said transfer roller to form a paper receiving nip therebetween, clamping means, means mounting said clamping means on said transfer roller for movement therewith, said clamping means being actuatable between an open position at which it is adapted to receive a portion of a copy sheet and a closed position at which it clamps said copy sheet to said transfer roller for movement therewith, means normally positioning said transfer roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said transfer roller for restoring said clamping means to its open position, pickoff means to separate said copy sheet from said transfer roller, said clamping means comprising means forming a diametral bore extending through said transfer roller, a member mounted in said bore for movement in the direction of the axis thereof, a clamping element carried by one end of said member, means forming a clamping surface on said transfer roller for cooperation with said element, an actuating element at the other end of said member, means for biasing said element toward engagement with said surface in the closed position of said clamping means, the dimensions being such that said actuating element protrudes from the end of said bore remote from said clamping element when said clamping means is in its closed position, said means normally actuating said clamping means to its open position comprising roller means, means mounting said roller in cooperative relationship with said transfer roller to engage said actuating element when said clamping means is in alignment with said nip, and, said image bearing surface engaging said actuating element to enable said pickoff means to separate said copy sheet from said transfer roller.

11. In a copying machine in which a toner image is to be transferred from a moving surface carrying said image to a length of copy sheet, apparatus including a transfer roller, means for rotatably supporting said transfer roller adjacent to said surface, a synchronizing roller, means mounting said synchronizing roller in cooperative relationship with said transfer roller to form a sheet receiving nip, clamping means comprising means forming a diametral bore extending through said transfer roller, a member mounted in said bore for movement in the direction of the axis thereof, a clamping element carried by one end of said member, means forming a clamping surface on said transfer roller for cooperation with said element, an actuating element at the other end of said member, means for biasing said element toward engagement with said surface in the closed position of said clamping means, the dimensions being such that said actuating element protrudes from the end of said bore remote from said clamping element when said clamping means is in its closed position, means normally positioning said transfer roller such that said clamping element is in alignment with said nip, stationary means for engaging said actuating element to move said clamping means to an open position to receive a portion of a copy sheet fed thereto, means mounting said stationary means in cooperative relationship with said transfer roller such that when the roller returns to its normal position said clamping means is opened and when said transfer roller is rotated from said normal position said clamping means is closed, paper pickoff means, means mounting said paper pickoff means such that when said image bearing surface engages said actuating element to open said clamping means, releasing said copy paper, said pickoff means separates said paper from said drum.

12. In a copier having a moving imaging surface from which a developed image is transferred to a copy sheet fed to said surface at a transfer station and having means for producing a synchronizing signal, apparatus including a roller, means mounting said roller in cooperative relationship with said imaging surface at said transfer station, clamping means, means mounting said clamping means on said roller for movement therewith, said clamping means being actuable between an open position at which it is adapted to receive a portion of a copy sheet and a closed position at which it clamps said copy sheet to said roller for movement therewith, means normally positioning said roller and actuating said clamping means to its open position to receive a portion of a copy sheet fed thereto, means responsive to said synchronizing signal for actuating said clamping means to its closed position to clamp said sheet portion to said roller and to drive said roller to carry said sheet through said transfer station, and means responsive to a predetermined rotary movement of said roller for restoring said clamping means to its open position, said clamping means comprising means forming a diametral bore in said roller, a member mounted in said bore for movement in the direction of the axis thereof, a clamping element carried by said member, means forming a clamping surface on said roller for cooperaton with said element, means for biasing said member to move said element toward said surface in the closed position of said clamping means, an axial bore in said roller intersecting said diametral bore, a rod in said axial bore, and means responsive to a force exerted on said rod for moving said clamping means to its open position, comprising a recess in said rod, a follower on said member, means biasing said rod such that said follower normally rests in said recess, means for exerting a force on said rod moving said follower out of said recess, opening said clamping means.

* * * * *